US007997441B2

(12) United States Patent
Marcel

(10) Patent No.: US 7,997,441 B2
(45) Date of Patent: Aug. 16, 2011

(54) TANK CONTAINER, FRAME, HOIST EYES AND PROTECTIVE STRUCTURES

(76) Inventor: Eric P. Marcel, Mamou, LA (US)

( * ) Notice: Subject to any disclaimer, the term of this patent is extended or adjusted under 35 U.S.C. 154(b) by 671 days.

(21) Appl. No.: 12/060,597

(22) Filed: Apr. 1, 2008

(65) Prior Publication Data

US 2009/0242576 A1 Oct. 1, 2009

(51) Int. Cl.
*B65D 88/12* (2006.01)

(52) U.S. Cl. ..... 220/647; 220/1.5; 220/668; 220/562; 206/386

(58) Field of Classification Search ..... 220/1.5, 220/668, 565, 562, 647; 206/386; 294/68.3
See application file for complete search history.

(56) References Cited

U.S. PATENT DOCUMENTS

| | | | | | |
|---|---|---|---|---|---|
| 1,203,483 | A * | 10/1916 | Carrier | 294/68.21 |
| 2,063,651 | A * | 12/1936 | Woodruff | 294/68.3 |
| 3,185,516 | A * | 5/1965 | Johansson | 294/68.21 |
| 4,989,447 | A * | 2/1991 | Gelin | 73/49.2 |
| 4,989,741 | A * | 2/1991 | Dull et al. | 220/1.5 |
| 5,996,827 | A * | 12/1999 | Splane | 220/1.5 |
| 6,079,580 | A * | 6/2000 | Garton et al. | 220/1.5 |
| 7,017,741 | B1 * | 3/2006 | Williamson | 206/386 |
| 7,244,123 | B1 * | 7/2007 | Barron | 434/226 |
| 7,475,796 | B2 * | 1/2009 | Garton | 222/185.1 |

* cited by examiner

*Primary Examiner* — Stephen Castellano

(57) ABSTRACT

Embodiments provide a tank container including a base adapted to rest on an external support, an open frame joined to the base in spaced relation to a tank barrel, the frame defining a space about the tank barrel, an open protective structure supported by the frame, the protective structure impeding contact between the flange and an external structural agent, hoist engagement structure adapted to receive hoist rigging, and rigging protective structure supported by the frame.

17 Claims, 6 Drawing Sheets

TANK CONTAINER, FRAME, HOIST EYES AND PROTECTIVE STRUCTURES

FIELD OF INVENTION

The disclosure relates to tank containers.

BACKGROUND OF INVENTION

A tank container is used to contain and transport a load of fluid material. The tank container includes a tank barrel for containing the fluid material. The tank container includes a container frame supporting the tank barrel. The container frame is adapted to rest on a suitable support. The support can be a floor or rack of a facility, or a deck or rack of a transport. The container frame can be adapted to be lifted or hoisted by a suitable lift or hoist. For example, in an arrangement, the container frame can be engaged by lifting apparatus such as a forklift. In an arrangement, the container frame can be engaged by hoist apparatus, such as a single point hoist. The single point hoist can include a hoist hook supported by a hoist cable. In one arrangement, the hoist hook supports rigging suitable to engage the tank container. The rigging can include a set of wire rope slings supported by the hoist hook and arranged to engage the tank container.

For the reasons stated above, and for other reasons stated below which will become apparent to those skilled in the art upon reading and understanding the present specification, there is a need in the art for improved tank containers.

BRIEF DESCRIPTION OF INVENTION

The disclosure provides improved tank containers. Various shortcomings, disadvantages and problems of tank containers are addressed herein, which will be understood by reading and studying the following specification.

DETAILED DESCRIPTION OF EMBODIMENTS

In the following detailed description, reference is made to the accompanying drawings that form a part hereof, and in which is shown by way of illustration specific embodiments which can be practiced. The embodiments are described in sufficient detail to enable those skilled in the art to practice the embodiments, and it is to be understood that other embodiments can be utilized and that logical, mechanical and other changes can be made without departing from the scope of the embodiments. The following detailed description is, therefore, not to be taken in a limiting sense.

Figure 1:
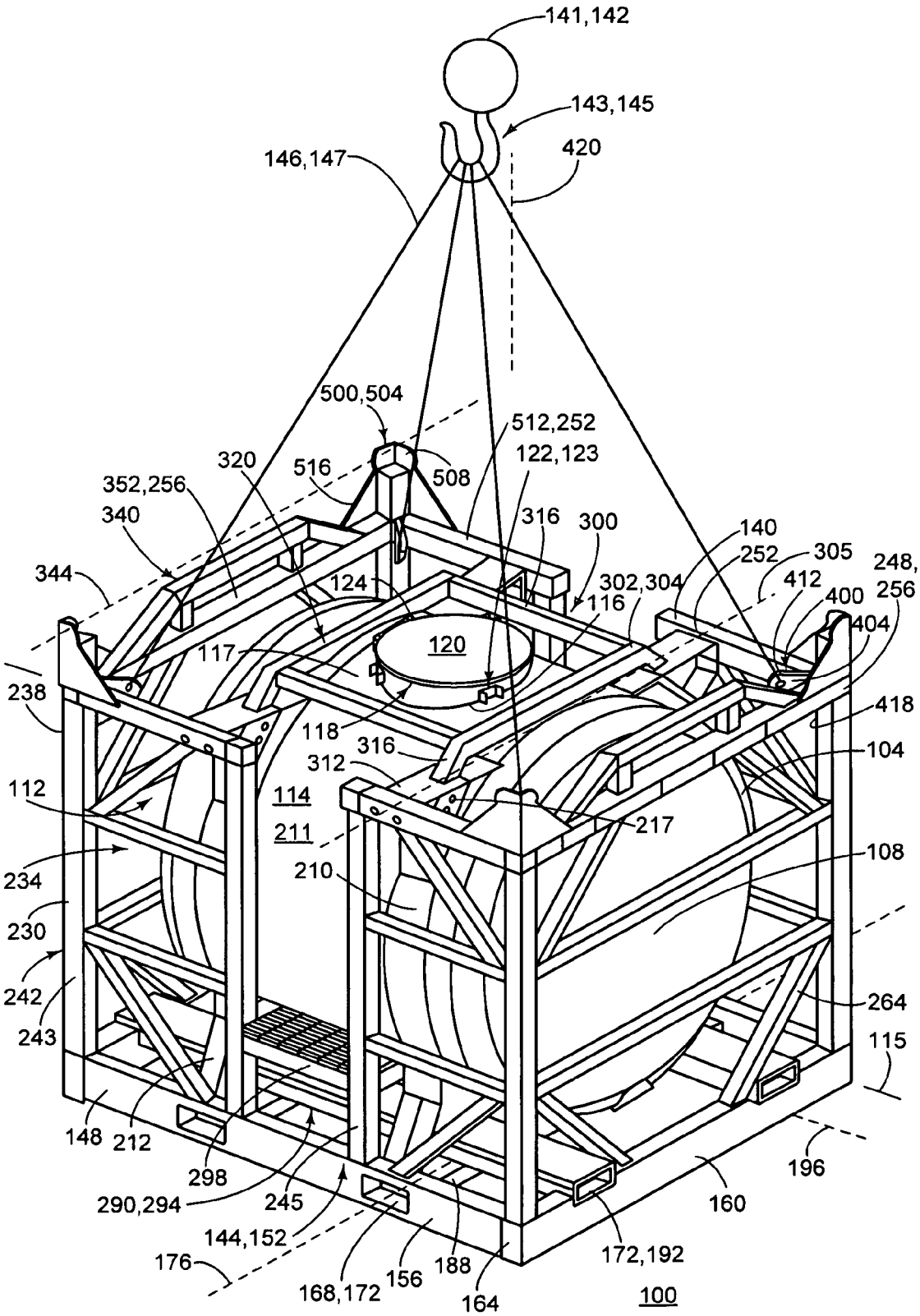
FIG. 1 is an elevated front perspective view of a tank container according to an embodiment.

FIG. 1 is an elevated front perspective view of a tank container 100 according to an embodiment. One skilled in the art will appreciate that tank container 100 can be configured differently without departing from the scope of the present disclosure and embodiments.

Figure 4:
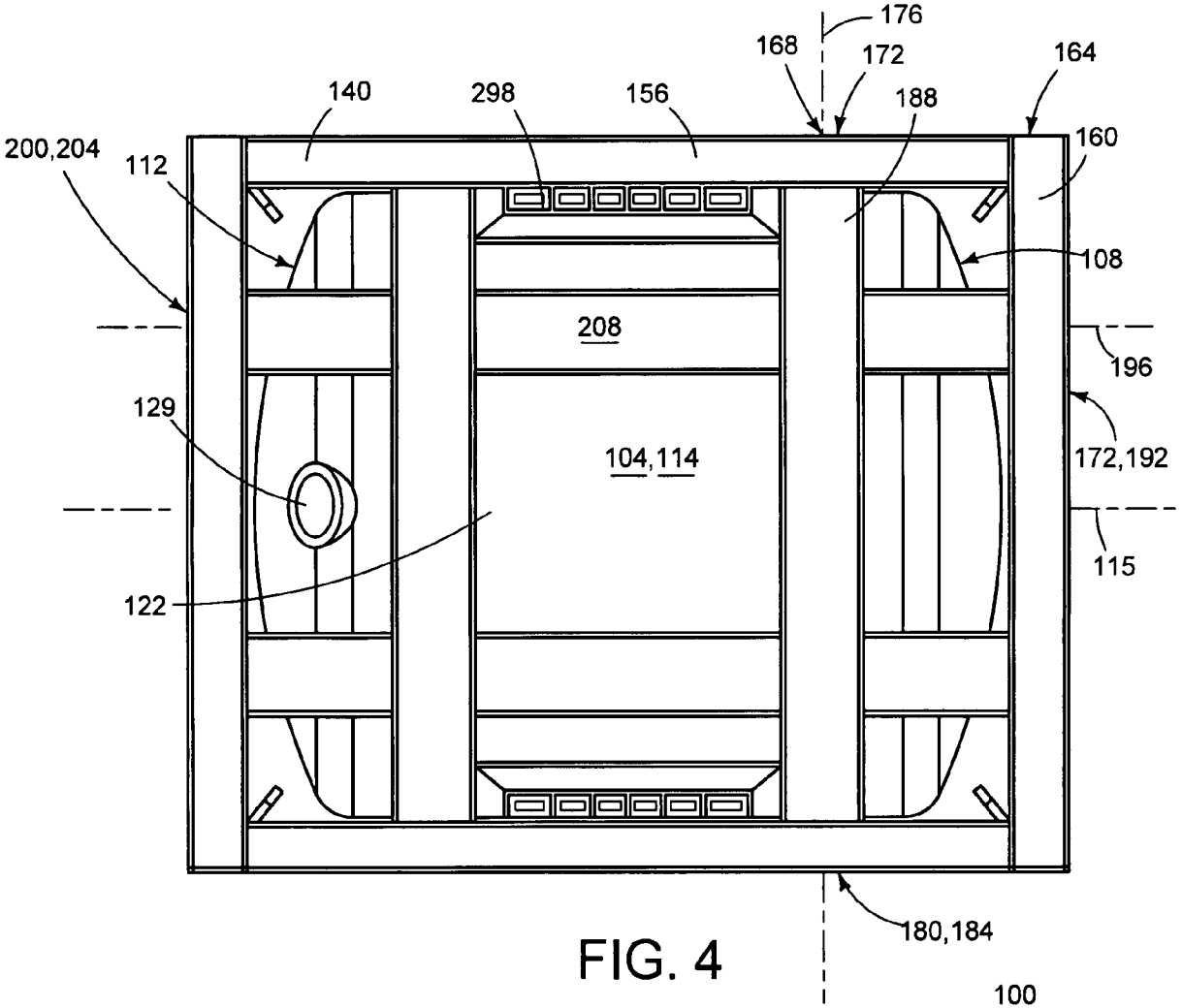
FIG. 4 is a bottom plan view of the tank container taken generally along 4-4 in FIG. 1.
Figure 5:
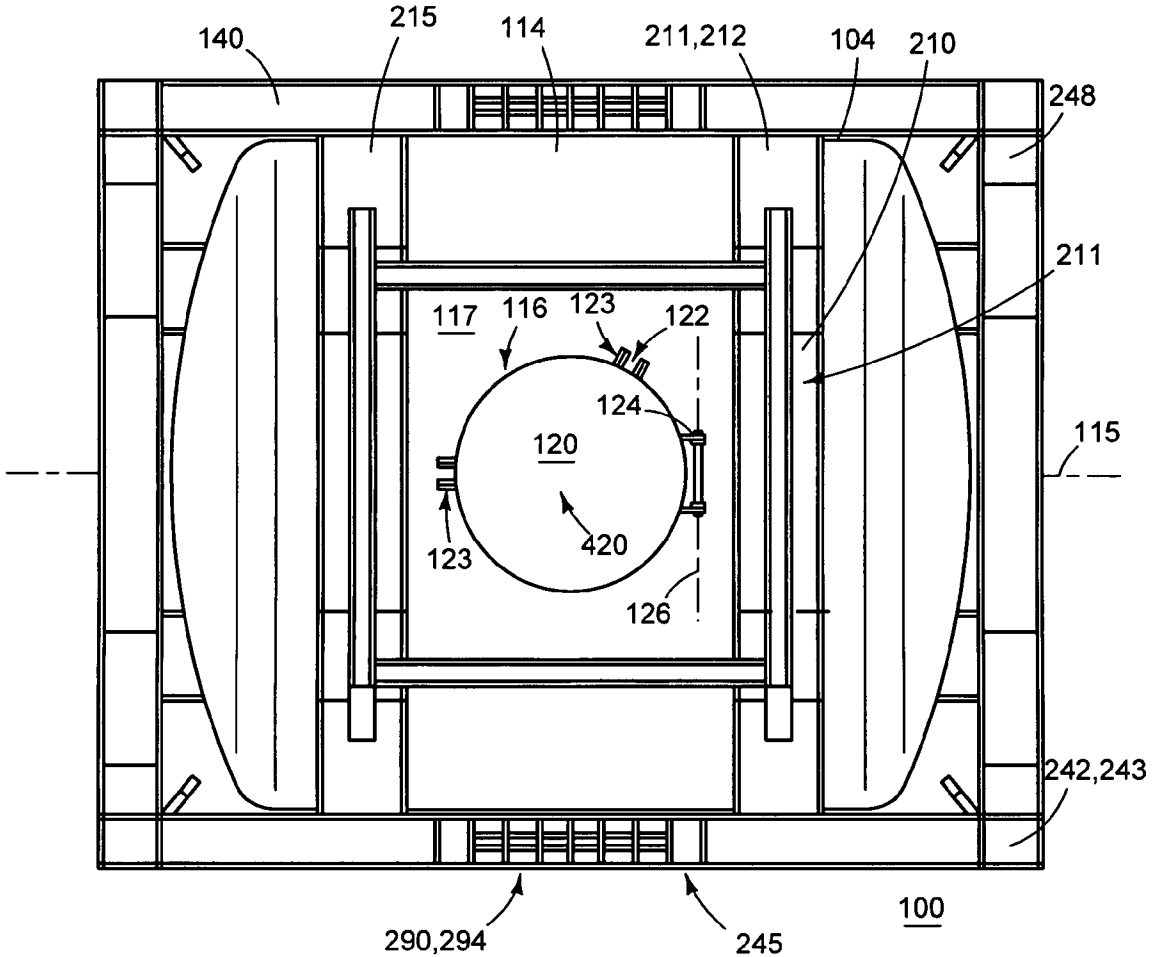
FIG. 5 is a top plan view of the tank container taken generally along 5-5 in FIG. 1.
Figure 6:
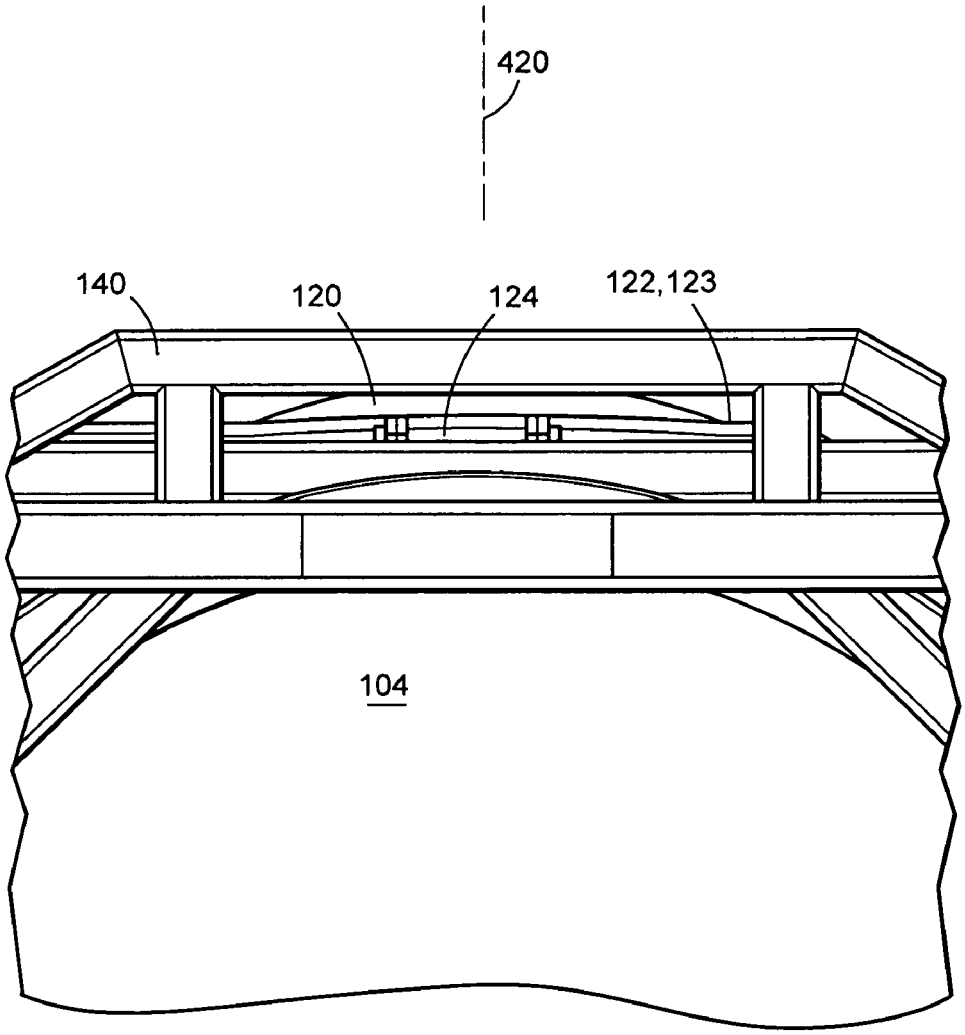
FIG. 6 is an enlarged partial view of the area indicated by 6-6 in FIG. 3.

Tank container 100 includes tank barrel 104 adapted to contain a load of fluid material (not shown). Tank barrel 104 can be of any suitable configuration and dimensions to contain a desired load. In the embodiment illustrated in FIG. 1, tank barrel 104 includes a pair of spaced, convex end walls 108,112 extending generally in a vertical direction. In the embodiment shown in FIG. 1, the end walls 108 and 112 are spaced apart in a horizontal direction. Tank barrel 104 includes a continuous cylindrical tank wall 114 extending in the horizontal direction and connecting the end walls 108, 112. Tank wall 114 cooperates with the end walls 108,112 to define an interior compartment (not shown) suitable to contain the load of fluid material (not shown). Except as otherwise described herein, tank barrel 104 is generally symmetrical about a longitudinal axis 115. Tank barrel 104 includes a flange 116 joining and extending from a top portion 117 of tank wall 114. Flange 116 terminates in a continuous upper lip 118. Tank barrel 104 includes a flange lid 120. Flange lid 120 is supported in a closed position (shown in FIG. 1) by upper lip 118 of flange 116. Flange lid 120 is retained in engagement with the upper lip 118 of flange 116 by cooperation of a plurality of releasable locking members 122 with mating fittings 123 on flange 116 (see FIG. 5). In the specific embodiment illustrated, the locking members 122 are supported on flange lid 120 for selective releasable engagement with corresponding mating fittings 123 on flange 116. In the specific embodiment illustrated, flange lid 120 is also joined to flange 116 by an elbow hinge 124. Elbow hinge 124 defines a horizontal pivot axis 126 (FIG. 5). Elbow hinge 124 supports flange lid 120 for pivotal movement relative to pivot axis 126 and flange 116 between the closed position (shown in FIG. 1) and an open position (not shown). Cooperation of flange 116 and continuous upper lip 118 defines a flange opening (not shown). In one arrangement, a valve assembly (not shown) is fitted in the flange opening (not shown) and is operable to selectively control communication between the interior compartment (not shown) and an external environment. The valve assembly (not shown) is operable to enable filling the tank barrel 104 with fluid material (not shown) through a suitable inlet port (not shown). Referring to FIG. 4, an outlet port 129 extends through a bottom portion 122 of the tank wall 114. Outlet port 129 is in communication with the interior compartment (not shown) for emptying fluid material from tank barrel 104. One skilled in the art will appreciate that the valve assembly (not shown) can be operated to create desired conditions in the interior compartment. One skilled in the art will appreciate that tank barrel 104 is constructed of material suitable to contain the fluid material. In the embodiment illustrated in FIG. 1, tank barrel 104 is constructed of stainless steel. In an embodiment, tank barrel 104 is complies with T-11 certification according to IMDG. In an embodiment, tank barrel 104 is removable from container frame 140 to permit container frame 140 to be galvanized.

Tank container 100 includes container frame 140. Container frame 140 has a configuration suitable to support tank barrel 104. In an embodiment, container frame 140 complies with the DNV 2.7-1 certification standard. In the specific embodiment illustrated, container frame 140 is suitable to support tank barrel 104 when containing a load of fluid material during storage, transport, and transfer. As used herein, "storage" means that tank container 100 is supported in a substantially stationary condition of a facility, such as on a floor or stationary rack. As used herein, "transport" means that tank container 100 is being carried between locations on a suitable movable transport, such as on a deck of a truck or ship. As used herein, "transfer" means that tank container 100 is being moved between a first substantially stationary condition and a second substantially stationary condition. During transfer, tank container 100 is supported and moved by operation of suitable transfer apparatus 141. Transfer apparatus 141 can include any suitable lift apparatus (not shown), such as a forklift or grapple arms. Transfer apparatus 141 can include any suitable hoist apparatus 142. In the specific embodiment illustrated in FIG. 1, hoist apparatus 142 includes a single point hoist 143. Single point hoist 143 includes a hoist hook 145. Hoist rigging 147 including a plurality of suitable wire rope slings 146 are supported by hoist hook 145. Each wire rope sling 146 engages a respective lifting eye 404 of container frame 140, as further described herein. It will be understood that, as used herein, "storage", "transport", and "transfer" are intended to describe all possible conditions of tank container 100, whether containing a load in any condition or status. One skilled in the art will appreciate that different terminology can be used to describe conditions and states of a tank container, without departing from the scope of the embodiments and disclosure.

Container frame 140 can be of any configuration and dimensions suitable to support tank barrel 104 containing a load of fluid material. One skilled in the art will appreciate that container frame 140 can be constructed of any suitable material. In the embodiment illustrated in FIG. 1, container frame 140 is constructed of carbon steel. One skilled in the art will appreciate that container frame 140 illustrated in FIG. 1 illustrates only one specific configuration, and a container frame can have different configurations without departing from the scope of the embodiments and the present disclosure. As shown in FIG. 1, container frame 140 includes base 144. Base 144 includes a plurality of intersecting base members 148. Base members 148 cooperate to define an open frame 152. Base members 148 include a pair of elongated side members 156 extending in spaced, parallel relationship. Base members 148 include a spaced pair of elongated end members 160 extending perpendicular to side members 156. The pair of end members 160 intersects and is joined in fixed relation to the pair of side members 156 at base corners 164. The end members 160 and side members 156 are joined in a suitable manner and, in the illustrated embodiment, are joined by respective welds at each corner 164. One skilled in the art will appreciate that side members 156 and end members 160 can be formed of any suitable material. In the embodiment shown in FIG. 1, side members 156 and end members 160 formed of carbon steel having a rectangular tubular cross-section.

Side members 156 have therein opposed side pairs 168 of spaced fork slots 172. The fork slots 172 are dimensioned to receive a respective fork (not shown) of a forklift (not shown) during transfers. Each fork slot 172 is aligned along a common axis 176 and spaced apart from an opposite one 180 of the fork slots 172. Each fork slot 172 and opposite one 180 thus cooperate to define an opposed lateral pair 184 of aligned fork slots 172. A respective lateral fork tube 188 extends between the spaced side members 156 in perpendicular relation thereto, and connects each opposed lateral pair 184 of fork slots 172. Each fork slot 172 and adjoining lateral fork tube 188 cooperate to capture an inserted fork (not shown) of a forklift (not shown). A pair of the lateral fork tubes 188 thus extends between the spaced side members 156 and terminates at respective fork slots 172. One skilled in the art will appreciate that lateral fork tubes 188 can be formed of any suitable material. In the embodiment shown in FIG. 1, lateral fork tubes 188 are carbon steel members having a rectangular tubular cross-section.

End members 160 have therein opposed end pairs 192 of spaced fork slots 172. As previously described, the fork slots 172 are dimensioned to receive a respective fork (not shown) of a forklift (not shown) during transfers. Each fork slot 172 is aligned along a common longitudinal axis 196 and spaced apart from an opposite one 200 of the fork slots 172. Each fork slot 172 and opposite one 200 thus cooperate to define an opposed longitudinal pair 204 of aligned fork slots 172. A respective longitudinal fork tube 208 extends between the spaced end members 160 in perpendicular relation thereto, and connects each opposed longitudinal pair 204 of fork slots 172. Each fork slot 172 and adjoining longitudinal fork tube 208 cooperate to capture an inserted fork (not shown) of a forklift (not shown). A pair of the longitudinal fork tubes 208 thus extends between the spaced end members 160 and terminates at respective fork slots 172. One skilled in the art will appreciate that longitudinal fork tubes 208 can be formed of any suitable material. In the embodiment shown in FIG. 1, longitudinal fork tubes 208 are carbon steel members having a rectangular tubular cross-section.

Container frame 140 includes a spaced pair of tank rings 210 in fixed engagement with continuous outer surface 211 about a circumference of tank sidewall 114 of tank barrel 104. The pair of tank rings 210 cooperates to support and retain tank barrel 104 in fixed relationship with base 144 of container frame 140. Container frame 140 includes four spaced pairs of tank braces 212. Tank braces 212 are spaced apart along the circumference of tank sidewall 114 and a respective tank ring 210 in two upper pairs and two lower pairs to engage and support the tank ring 210. Each tank ring 210 thus is engaged and supported in fixed relation to a respective upper pair and lower pair including four circumferentially spaced, aligned tank braces 212. It will be appreciated by those skilled in the art that tank braces 212 can be supported in any suitable manner. In the embodiment illustrated in FIG. 1, tank braces 212 are supported by base members 148 in fixed relation thereto. In the specific embodiment illustrated in FIG. 1, each tank brace 212 is supported by a respective lateral forklift tube 188. Although different configurations are possible, in the embodiment illustrated in FIG. 1, tank rings 210 and tank braces 212 cooperate with base 144 to support and retain tank barrel 104 in fixed relation to base 144 of container frame 140. A pair of the lateral fork tubes 188 thus extends between the spaced side members 156 and terminates at respective fork slots 172. One skilled in the art will appreciate that tank rings 210 and tank braces 212 can be formed of any suitable material. In the embodiment shown in FIG. 1, tank rings 210 are carbon steel sheet members having a curvature suitable to conform to continuous outer surface 211 of tank sidewall 114 of tank barrel 104. In the embodiment shown in FIG. 1, tank braces 212 are flanged members 213. Flanged members 213 are fabricated members each including a central web 214 integrally joined in fixed relation to respective lateral flanges 215. An internal one of the lateral flanges 215 is joined in fixed relation to tank ring 210 in a suitable manner. In the embodiment illustrated in FIG. 1, the internal one of the lateral flanges 215 is joined in fixed relation to tank ring 210 by suitable fasteners 217. One skilled in the art will appreciate that tank rings 210 and tank braces 212 can be joined in another suitable manner, such as by welded joints. Any suitable fasteners 217 can be used, and in the illustrated embodiment, fasteners 217 include suitable threaded bolt and nut combinations.

Container frame 140 includes a plurality of side members 230 spaced apart from tank barrel 104. The plurality of side members 230 cooperates to define a protected peripheral space 234 about a periphery of tank barrel 104. One skilled in the art will appreciate that the plurality of side members 230 can be arranged in any manner suitable to define a desired protected peripheral space 234 about tank barrel 104. As used herein, "protected peripheral space" means a space about a periphery of tank barrel 104 which is defined in relation to side members 230. Although different arrangements are possible, in the specific embodiment illustrated, side members 230 include a plurality of spaced vertical side members 238. Although the number and arrangement of vertical side members 238 can be different, in the specific embodiment illustrated container frame 140 includes eight vertical side members 238 spaced apart from tank barrel 104. Each vertical side member 238 is joined to base 144. More particularly, each vertical side member 238 extends in a vertical direction upward from base 144 in spaced relation to tank barrel 104. In the specific embodiment illustrated, each of four of the vertical side members 238 is joined to base 144 at respective of the corners 242. The four of the vertical side members 238 each joined to base 144 at a respective corner 242 can be identified, in the alternative, as four corner posts 243. Vertical side members 238 are joined to base 144 in a suitable manner. In the illustrated embodiment, vertical side members 238 which are corner posts 243 are joined in fixed relation to base 144 at respective corners 242. It will be appreciated by those skilled in the art that vertical side members 238 can be joined to base 144 in other suitable configurations, such that, for example, vertical side members 238 are selectively movable or foldable in relation to base 144. More particularly, in the embodiment illustrated in FIG. 1, each vertical side member 238 is joined to a respective side member 156 and end member 160 at respective corner 242 by welded joints (not shown). It will be understood that vertical side members 238 can be joined to at least one of base 144, a respective side member 156, and a respective end member 160 in another suitable manner such as, for example, by threaded fasteners. In the specific embodiment illustrated, each of four of the vertical side members 238 is joined to base 144 intermediate two of the corners 242 and, thus, intermediate two of the corner posts 243. The four vertical side members 238 joined to base 144 intermediate two of the corners 242 and intermediate two of the corner posts 243 can be identified, in the alternative, as four intermediate posts 245. The four intermediate posts 245 are joined to base 144 at respective intermediate positions in a suitable manner. In the illustrated embodiment, the intermediate posts 245 are each joined in fixed relation to base 144 at respective intermediate positions 247. It will be appreciated by those skilled in the art that intermediate posts 245 can be joined to base 144 in any suitable manner and configuration. More particularly, in the embodiment illustrated in FIG. 1, each intermediate post 245 is joined to a respective side member 156 by respective welded joints (not shown). One skilled in the art will appreciate that vertical side members 238, corner posts 243 and intermediate posts 245 can be formed of any suitable material. In the embodiment shown in FIG. 1, vertical side members 238, corner posts 243 and intermediate posts 245 are carbon steel members having a rectangular tubular cross-section.

Container frame 140 includes a plurality of spaced horizontal side members 248 extending between adjacent vertical side members 238 and spaced apart from tank barrel 104. One skilled in the art will appreciate that different suitable arrangements are possible. In the specific embodiment illustrated in FIG. 1, container frame 140 includes twelve spaced minor horizontal side members 252. Each minor horizontal side member 252 extends between a respective pair of adjacent vertical side members 238. In the specific embodiment illustrated in FIG. 1, container frame 140 includes six spaced major horizontal side members 256. Each major horizontal side member 252 extends between a respective pair of adjacent vertical side members 238. It will be appreciated that minor horizontal side members 252 and major horizontal side members 256 are of different lengths. More particularly, in the illustrated embodiment, the minor horizontal side members 252 are shorter than the major horizontal side members 252. Each minor horizontal side member 252 extends between an intermediate post 245 and an adjacent corner post 243. Each minor horizontal side member 252 thus extends in spaced, parallel vertical relation to a respective side member 156 of base 144. Each major horizontal side member 256 extends between a pair of adjacent corner posts 243. Each major horizontal side member 256 thus extends in spaced, parallel vertical relation to a respective end member 160 of base 144. One skilled in the art will appreciate that minor horizontal side members 252 and major horizontal side members 256 can be formed of any suitable material. In the embodiment shown in FIG. 1, minor horizontal side members 252 and major horizontal side members 256 are carbon steel members having a rectangular tubular cross-section. It will be appreciated by those skilled in the art that, in embodiments, horizontal side members 248 can be joined to vertical side members 238 in any suitable manner. In the embodiment illustrated in FIG. 1, each horizontal side member 248 is joined at opposite ends thereof to a respective pair of vertical side members 238 by welded joints (not shown). It will also be understood that, in embodiments, each minor horizontal side member 252 is joined at an end thereof to a corner post 243 and an opposite end to an intermediate post 245. It will be understood that, in embodiments, each major horizontal side member 256 is joined at opposite ends thereof to a respective pair of corner posts 243.

Container frame 140 includes a plurality of frame braces 264. One skilled in the art will appreciate that frame braces 264 can be arranged and configured in any suitable manner. In the specific embodiment illustrated container frame 140 includes eight upper frame braces 268 and eight lower frame braces 272. Each upper frame brace 268 and lower frame brace 272 extends in a diagonal direction in a generally vertical plane. More particularly, in the specific embodiment illustrated in FIG. 1, each upper frame brace 268 intersects an upper one 276 of the horizontal side members 256 and a lower one 280 of the horizontal side members 256. Although different configurations are suitable, in the embodiment illustrated in FIG. 1, each upper frame brace 268 intersects the lower one 280 of the horizontal side members 256 and a respective corner post 243 at a secondary corner 282. One will appreciate that secondary corner 282 is defined by an intersection of horizontal side member 256 and corner post 243. In the specific embodiment illustrated in FIG. 1, secondary corner 282 forms a ninety degree angle in a respective horizontal plane (not shown). In the specific embodiment illustrated in FIG. 1, each lower frame brace 272 intersects base 144 and a lowest one 284 of the horizontal side members 256 and base 144. One will appreciate by reference to FIG. 1 that, in the specific embodiment illustrated, certain of the lower frame braces 272 intersect base 144 at a respective side member 156, and certain of the lower frame braces 272 intersect base 144 at a respective end member 160. One will appreciate that frame braces 264 can be arranged and configured in any manner suitable to provide structural integrity of container frame 140. One skilled in the art will appreciate that frame braces 264, upper frame braces 268 and lower frame braces 272 can be formed of any suitable material. In the embodiment shown in FIG. 1, frame braces 264, upper frame braces 268 and lower frame braces 272 are carbon steel members having a rectangular tubular cross-section. It will be appreciated by those skilled in the art that, in embodiments, frame braces 264, upper frame braces 268 and lower frame braces 272 can be joined to horizontal side members 256, vertical side members 238 and base 144 in any suitable manner. In the embodiment illustrated in FIG. 1, each frame brace 264, upper frame brace 268 and lower frame brace 272 is joined at opposite ends thereof to respective of the horizontal side members 256, vertical side members 238 and base 144 by welded joints (not shown).

Container frame 140 includes a pair of access ways 290 spaced apart by tank barrel 104. Each access way 290 includes a respective unobstructed opening or gap 294 defined between a respective terminal pair 294 of adjacent intermediate posts 245. Each access way 290 is sufficiently wide to permit personnel (not shown) to step between the terminal pair 294 of intermediate posts 245 to gain access to tank barrel 104 at lid 120. Container frame 140 includes a pair of personnel steps 298 each aligned between a respective access way 290 and lid 120 of tank barrel 104. Personnel steps 298 can be supported in any suitable manner. In the embodiment illustrated in FIG. 1, each personnel step 298 is supported by a respective longitudinal fork tube 208. Personnel steps 298 are formed of a suitable non-slip material, such as an open grate, providing foot traction for personnel. Personnel step 298 and aligned access way 290 and lid 120 enable personnel to access lid 120 by entering through access way 290 to stand on personnel step 298 and without a ladder to reach hatch or lid 120 while standing on personnel step 298, to monitor fluid level in tank barrel 104, to fill the tank barrel 104, to engage and disengage lid bolts, to service a pressure relief device, and to perform actions while standing on personnel step 298. Personnel step 298 and aligned access way 290 enable personnel to access lifting eyes to attach and detach wire rope slings of the hoist for lifting tank container 100.

Figure 2:
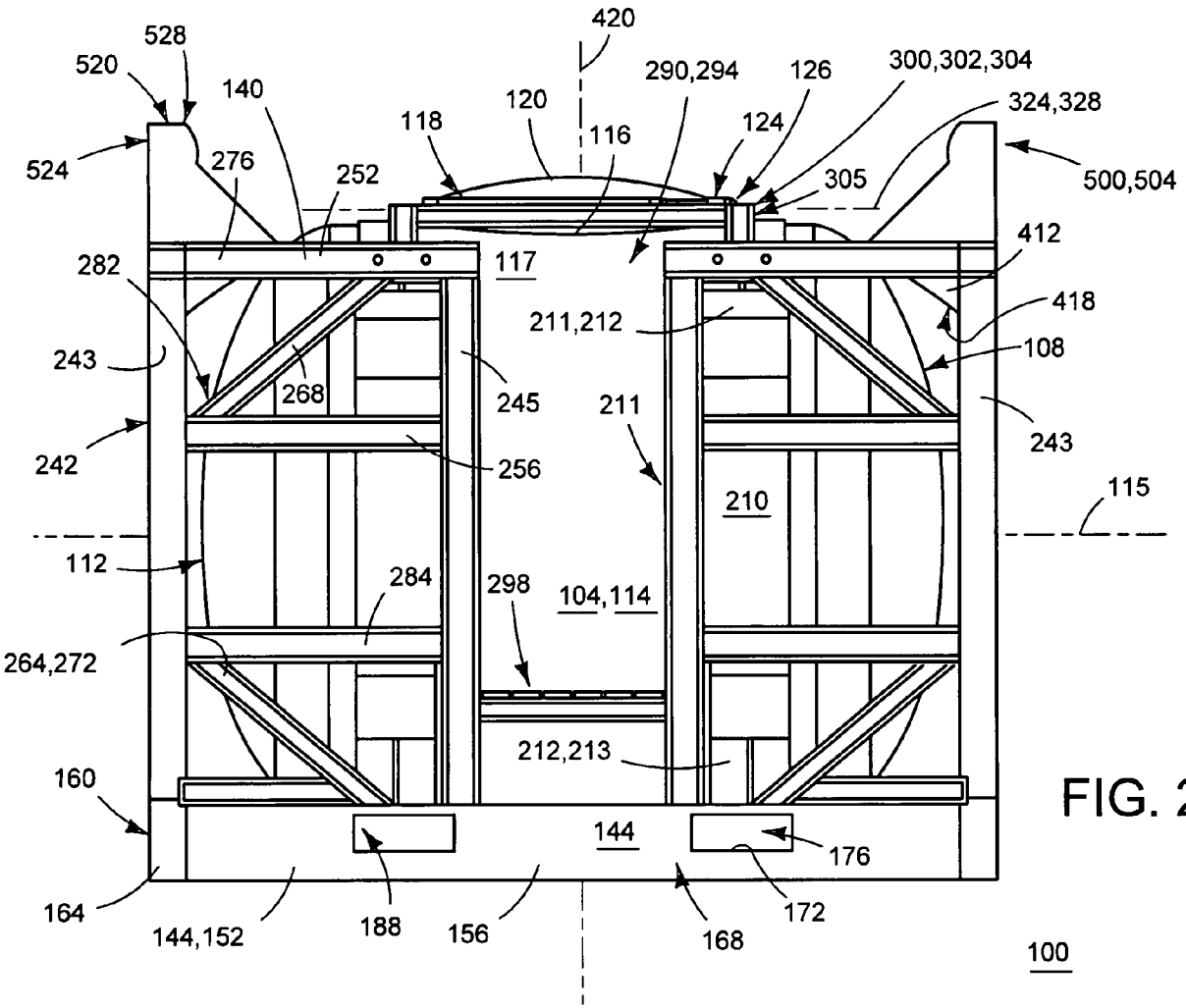
FIG. 2 is a front view of the tank container taken generally along 2-2 in FIG. 1.

Container frame 140 includes protective structure 300. Protective structure 300 is supported above sidewall 114 and adjacent flange 116 of tank barrel 104. Protective structure 300 is located or positioned in relation to tank barrel 104 and side members 230 to prevent unimpeded contact between external structural agents (not shown) and tank barrel 104 at flange 116, lid 120 and sidewall 114 in proximity to flange 116. Protective structure 300 can be formed in any suitable manner. In the embodiment illustrated in FIG. 1, protective structure 300 includes a plurality of protective members 302. Protective members 302 of protective structure 300 include a pair of lateral protective rails 304. Each lateral protective rail 304 has a respective lateral rail axis 305 extending in a direction perpendicular to longitudinal axis 115. Lateral rail axis 305 extends in a horizontal plane 324 (shown in FIG. 2). Each lateral protective rail 304 is supported in spaced relation to flange 116 and lid 120. More particularly, the lateral protective rails 304 are spaced from flange 116 and lid 120 in a longitudinal direction defined in general by longitudinal axis 115. In the specific embodiment illustrated in FIG. 1, each lateral protective rail 304 extends in general alignment with and spaced above a respective tank ring 210 in a direction perpendicular to longitudinal axis 115 of tank barrel 104. Each lateral protective rail 304 is supported by being joined to at least one fixed support of container frame 140. In the specific embodiment illustrated in FIG. 1, each lateral protective rail 304 is joined in fixed relation to a pair of the tank braces 212. Lateral protective rails 304 can be joined to tank braces 212 in any suitable manner. In the specific embodiment illustrated in FIG. 1, lateral protective rails 304 are joined to respective tank braces 212 by welded joints. It will be understood that lateral protective rails 304 can be of any desired configuration. In the embodiment illustrated in FIG. 1, each lateral protective rail 304 is an elongated member formed of tubular steel and having a rectangular cross section. Each lateral protective rail 304 has spaced ends 312 and includes a respective bend 316 adjacent each end 312. Each end 312 terminates at a respective lateral flange 215 of a tank brace 212. The ends 312 of lateral protective rail 304 are joined by respective welded joints to the lateral flanges 215. Each lateral protective rail 304 has a central section 320 intermediate bends 316. Central section 320 extends in a horizontal plane in the direction perpendicular to longitudinal axis 115. Central section 320 is spaced in the vertical direction above tank ring 210 and sidewall 114, such that lateral rail axis 305 is spaced from adjacent flange 112 and lid 120 in a common horizontal plane 324 (shown in FIG. 2) with at least one of flange 112 and lid 120. One will appreciate that, in embodiments (not shown in FIG. 1), horizontal plane 324 defined by lateral rail axis 305 of central section 320 can be spaced above flange 112 and lid 120 in the vertical direction. In an embodiment, each lateral protective rail 304 functions as a handrail and point of attachment for a safety lanyard in conformance with applicable safety standards such as OSHA standards.

Protective members 302 of protective structure 300 include a pair of longitudinal protective rails 316. Each longitudinal protective rail 316 has a respective longitudinal rail axis 328 extending in a direction parallel to longitudinal axis 115. Longitudinal rail axis 328 extends in a horizontal plane 324 (shown in FIG. 2). Each longitudinal protective rail 316 is supported in spaced relation to flange 116 and lid 120. More particularly, the longitudinal protective rails 316 are spaced from flange 116 and lid 120 in a lateral direction perpendicular to longitudinal axis 115, such that longitudinal rail axis 328 extends parallel to longitudinal axis 115. In the specific embodiment illustrated in FIG. 1, each longitudinal protective rail 316 extends between and is joined to the pair of lateral protective rails 304. Each longitudinal protective rail 316 is supported by being joined to at least one fixed support of container frame 140. In the specific embodiment illustrated in FIG. 1, each longitudinal protective rail 316 is joined in fixed perpendicular relation to the pair of lateral protective rails 304. Longitudinal protective rails 316 can be joined to lateral protective rails 304 in any suitable manner. In the specific embodiment illustrated in FIG. 1, longitudinal protective rails 316 are joined to respective lateral protective rails 304 at respective bends 316 by welded joints. It will be understood that longitudinal protective rails 316 can be of any desired configuration. In the embodiment illustrated in FIG. 1, each longitudinal protective rail 316 is an elongated member formed of tubular steel and having a rectangular cross section. Each longitudinal protective rail 316 is spaced in the vertical direction above sidewall 114, such that longitudinal rail axis 328 is spaced in a lateral direction from adjacent flange 112 and lid 120 in the common horizontal plane 324 defined by lateral rail axis 305 (shown in FIG. 2) and at least one of flange 112 and lid 120. In an embodiment, each longitudinal protective rail 316 functions as a handrail and point of attachment for a safety lanyard in conformance with applicable safety standards such as OSHA standards.

Figure 3:
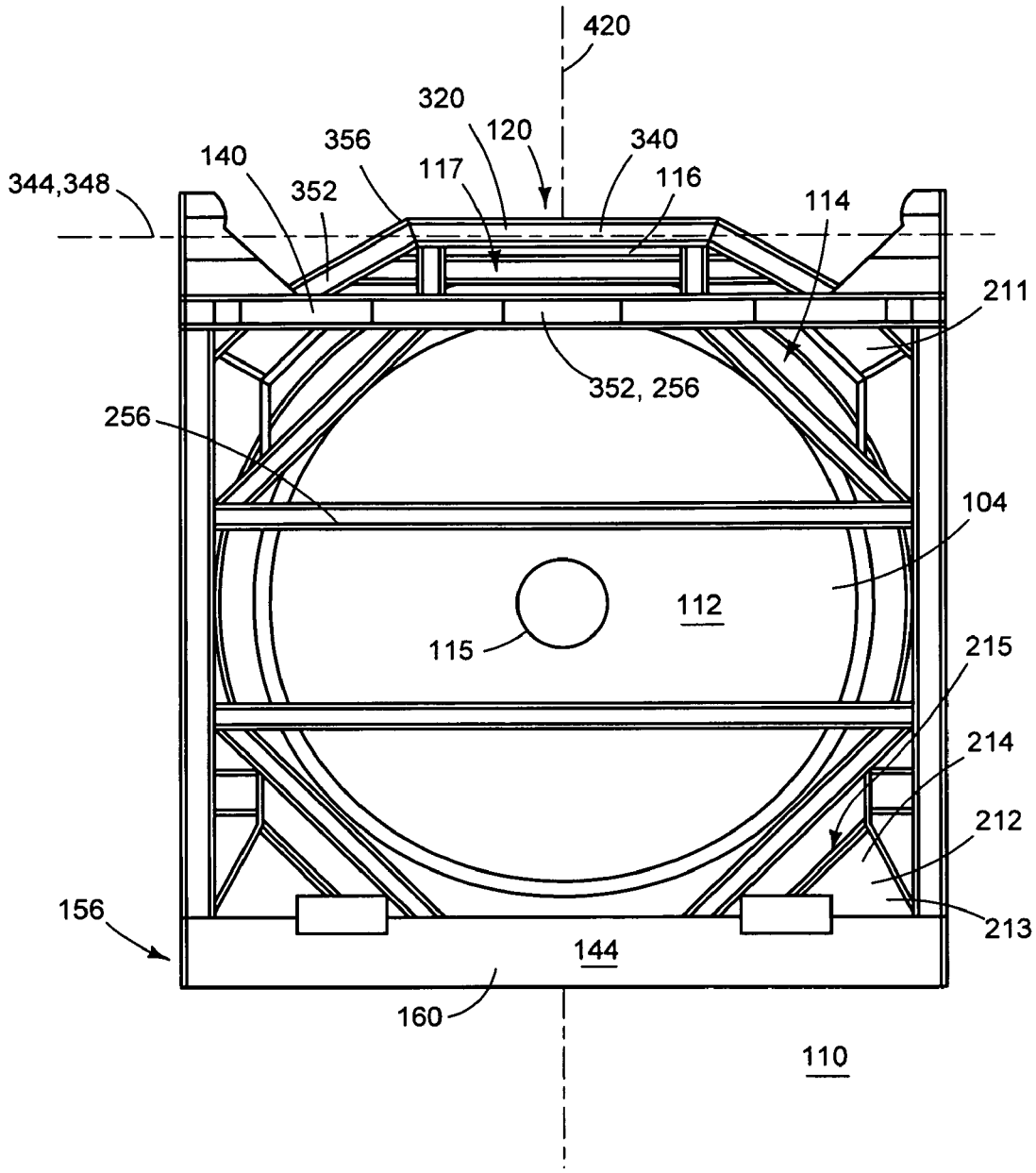
FIG. 3 is an end view of the tank container taken generally along 3-3 in FIG. 1.

Protective members 302 of protective structure 300 include a pair of secondary lateral protective rails 340. Each secondary lateral protective rail 340 has a respective secondary lateral rail axis 344 extending in a direction perpendicular to longitudinal axis 115. Secondary lateral rail axis 344 extends in a secondary horizontal plane 348 (shown in FIG. 3). Each secondary lateral protective rail 340 is supported in spaced relation to a respective end wall 108,112 of tank barrel 104 and respective upper one 352 of the major horizontal members 256. More particularly, the secondary lateral protective rails 340 are spaced from end walls 108,112 in a longitudinal direction defined in general by longitudinal axis 115. In the specific embodiment illustrated in FIG. 1, each secondary lateral protective rail 340 extends in general alignment with and spaced above a respective upper one 352 of the major horizontal members 256 in a direction perpendicular to longitudinal axis 115 of tank barrel 104. Each secondary lateral protective rail 340 is supported by being joined to at least one fixed support of container frame 140. In the specific embodiment illustrated in FIG. 1, each secondary lateral protective rail 340 is joined in fixed relation to a respective upper one 352 of the major horizontal members 256. Secondary lateral protective rails 340 can be joined to the major horizontal members 256 in any suitable manner. In the specific embodiment illustrated in FIG. 1, secondary lateral protective rails 340 are joined to respective upper ones 352 of the major horizontal members 256 by welded joints. It will be understood that secondary lateral protective rails 340 can be of any desired configuration. In the embodiment illustrated in FIG. 1, each secondary lateral protective rail 340 is an elongated member formed of tubular steel and having a rectangular cross section. Each secondary lateral protective rail 340 has spaced ends 352 and includes a respective bend 356 adjacent each end 352. Each end 352 terminates at the respective upper one 352 of the major horizontal members 256. The ends 352 of secondary lateral protective rail 340 are joined by respective welded joints to the respective major horizontal member 256. Each secondary lateral protective rail 340 has a central section 360 intermediate bends 356. Central section 360 extends in a secondary horizontal plane 348 in the direction perpendicular to longitudinal axis 115. Central section 360 is spaced in the vertical direction above upper one 352 of the major horizontal members 256, such that secondary lateral rail axis 344 is spaced above respective end wall 108,112 in a vertical direction and outward from respective end wall 108, 112 in a longitudinal direction defined in general by longitudinal axis 115. Although one skilled in the art will appreciate that different configurations are possible, in the embodiment illustrated in FIG. 1, secondary horizontal plane 348 is spaced above horizontal plane 324 in a vertical direction perpendicular to horizontal axis 115. Lateral protective rails 340 thus prevent and impede contact between external objects or external structural agents (not shown) and lateral protective rails 304, longitudinal protective rails 316, tank barrel 104, end walls 108,112, flange 116, lid 120 and sidewall 114. In an embodiment, each secondary lateral protective rail 340 functions as a handrail and point of attachment for a safety lanyard in conformance with applicable safety standards such as OSHA standards.

Container frame 140 includes hoist engagement structure 400. One skilled in the art will appreciate that, in embodiments, hoist engagement structure 400 can include any structure suitable to be engaged by hoist 142 for hoisting tank container 100. In the specific embodiment illustrated in FIG. 1, hoist engagement structure 400 includes a plurality of eyes 404. Each eye 404 defines a respective opening suitable to receive a respective wire rope 146 of hoist rigging 147. Each eye 404 is formed in a respective support member 412. Each support member 412 is integrally joined to container frame 140 in a manner sufficient to bear a load when hoist 143 is operated to raise and move container frame 140. In the illustrated embodiment, each support member 412 is an ear shaped member integrally joined to a respective internal corner section 418 of a respective corner post 243. Each support member 412 extends inwardly from respective corner post 243 in the general direction of central vertical axis 420 of tank container 100.

Container frame 140 includes rigging protective structure 500. One skilled in the art will appreciate that, in embodiments, rigging protective structure 500 can include any structure suitable to prevent contact between external structural agents (not shown) and wire rope slings 146 of hoist rigging 147. In the specific embodiment illustrated in FIG. 1, rigging protective structure 500 includes a plurality of protective crowns 504. Each protective crown 504 is supported in proximity to a respective eye 404 in a position preventing contact between an external structural agent (not shown) and hoist engagement structure 400, eye 404, support member 412, or wire rope slings 146 of hoist rigging 147. Each protective crown 504 is integrally joined to at least one other member of container frame 140. In the embodiment illustrated in FIG. 1, each protective crown 504 is joined to a respective corner post 243. Each protective crown 504 includes an extension 508 of corner post 243 in a vertical direction generally parallel to vertical axis 420 and above the upper ones 352 of major horizontal side members 256 and upper ones 512 of minor horizontal side members 252. Each protective crown 504 includes a shield plate 516. One skilled in the art will appreciate that shield plate 516 can be of any configuration suitable to prevent contact between an external structural agent (not shown) and hoist engagement structure 400, eye 404, support member 412, or wire rope slings 146 of hoist rigging 147. In the specific embodiment illustrated in FIG. 1, shield plate 516 extends from the upper ones 352 of major horizontal side members 256 and upper ones 512 of minor horizontal side members 252 to a major terminus 520 above extension 508. Shield plate 516 is formed with a ninety degree corner 524 at major terminus 520 and extension 508. Shield plate 516 defines a continuous upper edge 528. Upper edge 528 extends downward from major terminus 520 to the upper one 352 of major horizontal side member 256 and upper one 512 of minor horizontal side member 252. Shield plate 516 is joined in fixed relation with at least one of corner post 243, upper one 352 of major horizontal side member 256 and upper one 512 of minor horizontal side member 252. It will be appreciated that protective crown 504, extension 508 and shield plate 516 are positioned in a vertical direction generally parallel to vertical axis 420 above hoist engagement structure 400, eye 404, support member 412, corner post 243, and a portion of wire rope sling 146 engaging eye 404 to prevent contact in a generally vertical direction between an external structural agent (not shown) and same. It will be appreciated that protective crown 504, extension 508 and shield plate 516 are positioned in a longitudinal direction generally parallel to longitudinal axis 115 outward from hoist engagement structure 400, eye 404, support member 412, corner post 243, and wire rope sling 146 of hoist rigging 147 to prevent contact in a generally longitudinal direction between an external structural agent (not shown) and same. It will be appreciated that protective crown 504, extension 508 and shield plate 516 are positioned in a lateral direction generally parallel to secondary lateral rail axis 344 outward from hoist engagement structure 400, eye 404, support member 412, corner post 243, and wire rope sling 146 of hoist rigging 147 to prevent contact in a lateral direction between an external structural agent (not shown) and same.

In view of the foregoing, embodiments provide protective structure 300 adapted to prevent or impede contact between external structural agents and tank barrel 104, and particularly flange 116, lid 120 and sidewall 114 of tank barrel 104. Embodiments provide rigging protective structure 500 adapted to prevent or impede contact between external structural agents and hoist engagement structure 400. Embodiments provide rigging protective structure 500 adapted to prevent or impede contact between external structural agents and hoist rigging 147, including wire rope slings 146 in proximity to hoist engagement structure 400 and rigging protective structure 500. Embodiments provide tank container 100 including protective structure 300, rigging protective structure 500 and container frame 140, in combination, which are adapted to prevent or impede contact between external structural agents and tank barrel 104, and particularly flange 116, lid 120 and sidewall 114 of tank barrel 104, during storage, transport and transfer. It will be understood that embodiments provide a container frame such as, for example, container frame 140, having construction, elements and improvements independent of a removable tank such as, for example, a tank generally similar to tank barrel 104. It will be understood that embodiments provide tank containers having construction, elements and improvements which are well-suited for transport, transfer and storage of fluid materials in rugged, off-shore marine environments, such as off-shore oil platforms. More particularly, it will be understood that embodiments provide tank containers which can be transported and transferred via suitable hoist equipment from supply vessels to off-shore oil platforms, and vice-versa, including protective structure 300, rigging protective structure 500 and container frame 140, in combination, which are adapted to prevent or impede contact between external structural agents and tank barrel 104, and particularly flange 116, lid 120 and sidewall 114 of tank barrel 104, and wire rope slings 146 of hoist rigging 147. Examples of external structural agents can include, for example in an off-shore oil platform environment, protruding structures such as beams and cables, and other cargo being transferred, when a tank container according to embodiment is being transferred via hoist equipment. One of skill in the art will appreciate that embodiments thus provide improved tank containers, and particularly improved tank containers adapted for storage, transport and transfer in off-shore marine environments such as oil platforms.

Although specific embodiments are illustrated and described herein, it will be appreciated by those of ordinary skill in the art that any arrangement which is calculated to achieve the same purpose can be substituted for the specific embodiments shown. This application is intended to cover any adaptations or variations. For example, although described in terms of the specific embodiments, one of ordinary skill in the art will appreciate that implementations can be made in different embodiments to provide the required function. In particular, one of skill in the art will appreciate that the names and terminology of the apparatus are not intended to limit embodiments. Furthermore, additional apparatus can be added to the components, functions can be rearranged among the components, and new components to correspond to future enhancements and physical devices used in embodiments can be introduced without departing from the scope of embodiments. The terminology used in this application is intended to include all environments and alternatives which provide the same functionality as described herein.

I claim:

1. A tank container adapted to rest on an external support, the tank container being adapted to be raised by a hoist, rigged with suitable hoist rigging, the tank container comprising:

a base adapted to rest on the external support;

a tank barrel supported by the base relative to the external support, the tank barrel having a continuous sidewall, the tank barrel having a longitudinal axis extending in a substantially horizontal direction, the tank barrel having a flange, the flange oriented in an upright position extending upward from the sidewall in a vertical direction relative to a vertical flange axis, the tank barrel being suitable to contain fluid material;

an open frame joined to the base in spaced relation to the tank barrel, the frame defining a space about the tank barrel;

an open protective structure supported by the frame, a major portion of the open protective structure defining a protective structure plane, the protective structure plane extending in a horizontal direction perpendicular to the vertical flange axis, the protective structure plane being located above the sidewall, the open protective structure being spaced from the vertical flange axis, the open protective structure being spaced from the flange, the open protective structure being spaced from the open frame in the direction of the vertical flange axis, the open protective structure impeding contact between the flange and an external structural agent occupying a position above the open protective structure, the open protective structure impeding contact between the sidewall and an external structural agent occupying a position above the open protective structure, the open protective structure impeding contact between the flange and an external structural agent occupying a position outside the open protective structure in a direction perpendicular to the vertical flange axis;

hoist engagement structure adapted to receive the hoist rigging, the hoist engagement structure including a plurality of eyes supported by the frame, each eye being adapted to receive hoist rigging, each eye being located in a respective first vertical plane, the first vertical plane being parallel to the vertical axis, the first vertical plane being spaced apart from the vertical flange axis by a first distance, each eye being located in a respective first horizontal plane, the first horizontal plane being perpendicular to the first vertical plane; and rigging protective structure supported by the frame, the rigging protective structure including a plurality of protective crowns each located in proximity to a respective eye, each protective crown being located in a respective second vertical plane, the second vertical plane being parallel to the first vertical plane, the second vertical plane being spaced apart from the vertical flange axis by a second distance, the second distance being greater than the first distance, each protective crown being located in a respective second horizontal plane, the second horizontal plane being parallel to the respective first horizontal plane, the second horizontal plane in the vertical direction being located above the first horizontal plane.

2. The tank container of claim 1 and further comprising:

secondary protective structure supported by the frame in spaced relation to the open protective structure, the secondary protective structure being located above at least a portion of the frame in a vertical direction, the secondary protective structure being spaced from the vertical flange axis in a horizontal direction, the secondary protective structure being spaced from the sidewall, the secondary protective structure impeding contact between the tank barrel and an external structural agent occupying a position above the frame, the secondary protective structure impeding contact between the open protective structure and an external structural agent occupying a position outside the secondary protective structure in a direction perpendicular to the vertical flange axis.

3. The tank container of claim 2 and further comprising:
the open protective structure including a set of intersecting rails spaced from the flange, the rails extending generally in a horizontal plane above the sidewall.

4. The tank container of claim 3 and further comprising:
tank braces adapted to support the tank barrel in fixed relation to the base;
the set of intersecting rails being supported by at least one of the following:
the frame, the tank braces.

5. The tank container of claim 3 and further comprising:
the secondary protective structure including a plurality of secondary rails supported by the frame, the secondary rails extending generally in a secondary horizontal plane above the frame.

6. The tank container of claim 1 and further comprising:
the base including at least one set of forklift tubes suitable to be engaged by a forklift.

7. The tank container of claim 1 and further comprising:
the frame defining an access way aligned with the flange, the access way defining a space in the frame, the space being sufficiently wide to permit personnel to step toward the tank barrel through the access way, the frame including a step adjacent the tank barrel to receive a foot of the personnel when stepping toward the tank barrel through the access way, the step being aligned generally between the access way and the flange.

8. A tank container adapted to rest on an external support, the tank container being adapted to be raised by a hoist, rigged with suitable hoist rigging, the tank container comprising:
a base adapted to rest on the external support;
a tank barrel supported by the base relative to the external support, the tank barrel having a continuous sidewall, the tank barrel having a longitudinal axis extending in a substantially horizontal direction, the tank barrel having a flange, the flange oriented in an upright position extending upward from the sidewall in a vertical direction relative to a vertical flange axis, the tank barrel being suitable to contain fluid material;
tank braces adapted to support the tank barrel in fixed relation to the base;
an open frame joined to the base in spaced relation to the tank barrel, the frame defining a space about the tank barrel;
an open protective structure supported by the frame, a major portion of the protective structure defining a protective structure plane, the protective structure plane extending in a horizontal direction perpendicular to the vertical flange axis, the protective structure plane being located above the sidewall, the protective structure being spaced from the vertical flange axis, the protective structure being spaced from the flange, the protective structure being spaced from the open frame in the direction of the vertical flange axis, the protective structure impeding contact between the flange and an external structural agent occupying a position above the protective structure, the protective structure impeding contact between the sidewall and an external structural agent occupying a position above the protective structure, the protective structure impeding contact between the flange and an external structural agent occupying a position outside the protective structure in a direction perpendicular to the vertical flange axis, the protective structure including a set of intersecting rails spaced from the flange, the rails extending generally in a horizontal plane above the sidewall, the set of intersecting rails being supported by at least one of the following: the frame, the tank braces;
hoist engagement structure adapted to receive the hoist rigging, the hoist engagement structure including a plurality of eyes supported by the frame, each eye being adapted to receive hoist rigging, each eye being located in a respective first vertical plane, the first vertical plane being parallel to the vertical axis, the first vertical plane being spaced apart from the vertical flange axis by a first distance, each eye being located in a respective first horizontal plane, the first horizontal plane being perpendicular to the first vertical plane; and
rigging protective structure supported by the frame, the rigging protective structure including a plurality of protective crowns each located in proximity to a respective eye, each protective crown being located in a respective second vertical plane, the second vertical plane being parallel to the first vertical plane, the second vertical plane being spaced apart from the vertical flange axis by a second distance, the second distance being greater than the first distance, each protective crown being located in a respective second horizontal plane, the second horizontal plane being parallel to the respective first horizontal plane, the second horizontal plane in the vertical direction being located above the first horizontal plane.

9. The tank container of claim 8 and further comprising:
secondary protective structure supported by the frame, the secondary protective structure being located above at least a portion of the frame in a vertical direction, the secondary protective structure being spaced from the vertical flange axis in a horizontal direction, the secondary protective structure being spaced from the sidewall, the secondary protective structure impeding contact between the tank barrel and an external structural agent occupying a position above the frame, the secondary protective structure impeding contact between the open protective structure and an external structural agent occupying a position outside the secondary protective structure in a direction perpendicular to the vertical flange axis, the secondary protective structure including a plurality of secondary rails supported by the frame, the secondary rails extending generally in a secondary horizontal plane above the frame.

10. The tank container of claim 8 and further comprising:
the base including at least one set of forklift tubes suitable to be engaged by a forklift.

11. A container adapted to support a tank barrel, the container being adapted to rest on an external support, the container being adapted to be raised by a hoist, rigged with hoist rigging, the container comprising:
a base adapted to rest on the external support;
a set of tank braces adapted to receive the tank barrel to support the same in fixed relation to the base;
an open frame joined to the base, the frame adapted to define an open space about a tank barrel received in the set of tank braces;
an open protective structure supported by the frame, a major portion of the open protective structure defining a protective structure plane, the protective structure plane extending in a horizontal direction perpendicular to a vertical flange axis, the vertical flange axis being a vertical axis defined through a flange of the tank barrel when the tank barrel is supported by the container, the protective structure plane being located above a sidewall of the tank barrel, the open protective structure being spaced from the vertical flange axis, the protective structure being spaced from the flange, the open protective structure being spaced from the open frame in the direction of the vertical flange axis, the open protective structure impeding contact between the flange and an external structural agent occupying a position above the open protective structure, the open protective structure impeding contact between the sidewall and an external structural agent occupying a position above the open protective structure, the open protective structure impeding contact between the flange and an external structural agent occupying a position outside the protective structure in a direction perpendicular to the vertical flange axis;

hoist engagement structure adapted to receive the hoist rigging, the hoist engagement structure including a plurality of eyes supported by the frame, each eye being adapted to receive hoist rigging, each eye being located in a respective first vertical plane, the first vertical plane being parallel to the vertical axis, the first vertical plane being spaced apart from the vertical flange axis by a first distance, each eye being located in a respective first horizontal plane, the first horizontal plane being perpendicular to the first vertical plane; and rigging protective structure supported by the frame, the rigging protective structure including a plurality of protective crowns each located in proximity to a respective eye, each protective crown being located in a respective second vertical plane, the second vertical plane being parallel to the first vertical plane, the second vertical plane being spaced apart from the vertical flange axis by a second distance, the second distance being greater than the first distance, each protective crown being located in a respective second horizontal plane, the second horizontal plane being parallel to the respective first horizontal plane, the second horizontal plane in the vertical direction being located above the first horizontal plane.

12. The container of claim 11 and further comprising:

secondary protective structure supported by the frame, the secondary protective structure being located above at least a portion of the frame in a vertical direction, the secondary protective structure being spaced from the vertical flange axis in a horizontal direction, the secondary protective structure being spaced from the sidewall, the secondary protective structure impeding contact between the tank barrel and an external structural agent occupying a position above the frame, the secondary protective structure impeding contact between the open protective structure and an external structural agent occupying a position outside the secondary protective structure in a direction perpendicular to the vertical flange axis.

13. The container of claim 11 and further comprising:

the open protective structure including a set of intersecting rails spaced from the flange, the rails extending generally in a horizontal plane above the sidewall.

14. The container of claim 13 and further comprising:

the set of intersecting rails being supported by at least one of the following:

the frame, the tank braces.

15. The container of claim 11 and further comprising:

the secondary protective structure including a plurality of secondary rails supported by the frame, the secondary rails extending generally in a secondary horizontal plane above the frame.

16. The container of claim 11 and further comprising:

the base including at least one set of forklift tubes suitable to be engaged by a forklift.

17. The container of claim 11 and further comprising:

the frame defining an access way aligned with the flange, the access way defining a space in the frame, the space being sufficiently wide to permit personnel to step toward the tank barrel through the access way, the frame including a step adjacent the tank barrel to receive a foot of the personnel when stepping toward the tank barrel through the access way, the step being aligned generally between the access way and the flange.

* * * * *